United States Patent [19]

Gunter et al.

[11] Patent Number: 4,596,196

[45] Date of Patent: Jun. 24, 1986

[54] FOLDING TABLE WITH GAS CYLINDERS

[75] Inventors: Gary T. Gunter, Verona; Carl F. Patterson, Tupelo, both of Miss.

[73] Assignee: Krueger, Inc., Green Bay, Wis.

[21] Appl. No.: 631,189

[22] Filed: Jul. 16, 1984

[51] Int. Cl.[4] ..... A47B 3/14

[52] U.S. Cl. ..... 108/113; 297/159; 108/37

[58] Field of Search ..... 108/113, 136, 37; 248/631

[56] References Cited

U.S. PATENT DOCUMENTS

| | | | |
|---|---|---|---|
| 2,909,399 | 10/1959 | Wasson et al. | 108/37 |
| 3,101,062 | 8/1963 | Kanzelberger | 108/113 |
| 3,143,982 | 8/1964 | Blink et al. | 108/37 |
| 3,337,262 | 8/1967 | Katzfey et al. | 297/159 |
| 3,715,143 | 2/1973 | Gerken et al. | 297/159 |
| 3,805,712 | 4/1974 | Taylor et al. | 108/136 |
| 3,874,696 | 4/1975 | Gardner et al. | 248/188.6 X |
| 4,026,221 | 5/1977 | Wilson et al. | 108/113 |
| 4,148,518 | 4/1979 | Vilbeuf | 248/631 X |

*Primary Examiner*—William E. Lyddane
*Assistant Examiner*—Peter A. Aschenbrenner
*Attorney, Agent, or Firm*—Fuller, House & Hohenfeldt

[57] ABSTRACT

A folding table assembly includes enclosed gaseous power cylinders for assisting the folding and unfolding operations. The cylinders are mounted to the supporting legs so that their weights are not added to that of the table members to be lifted. The cylinders exert constant forces tending to fold the table, and they provide cushions to resist the table weight during the unfolding operation.

4 Claims, 7 Drawing Figures

FOLDING TABLE WITH GAS CYLINDERS

BACKGROUND OF THE INVENTION

1. Field of the Invention

This invention pertains to folding tables, and more particularly to folding tables having means to assist the folding and unfolding operations.

2. Description of the Prior Art

Tables comprising two normally horizontal top sections hinged together for folding transversely into two generally parallel and vertical sections are well known. The principal advantage of such tables is that, in the folded condition, they occupy little floor space. The tables may include seating assemblies which fold and unfold together with the table top sections. Exemplary apparatus combining a table and seating arrangement is disclosed in U.S. Pat. No. 3,715,143.

Folding tables must withstand heavy use, so they are sturdily constructed. In addition, many applications of folding tables such as for cafeterias, either with or without seating assemblies, require large sizes. Accordingly, folding tables necessarily are quite heavy, and it normally requires considerable effort to fold them. Uncontrolled opening of a heavy folded table may cause considerable damage to the table and injury to the person operating the table.

To facilitate folding and unfolding large and heavy folding tables, counterbalance mechanisms of various types are commonly employed. U.S. Pat. No. 3,337,262 shows a pair of adjustable coil springs in conjunction with a folding table. U.S. Pat. No. 3,101,062 shows a hydraulic cylinder including a spring for assisting the closing movement and for cushioning the opening movement. The mechanisms of the U.S. Pat. Nos. 3,101,062 and 3,337,262 patents are attached to the hinges joining the table top sections; thus, their weights are added to the mass which the operating person must raise and lower. In addition, the springs do not exert a uniform force throughout the folding and unfolding operations.

The folding table of U.S. Pat. No. 3,715,143 employs torsion bars to assist the operating person raise and lower the table described therein. Although torsion bars possess several desirable features, they nevertheless have some deficiencies. These include non-uniform force through a folding and unfolding cycle, heaviness, and the necessity of heavy anchoring points for the bars. Another drawback of prior counterbalance mechanisms is the inability to construct them so they are interchangeable to suit a variety of table sizes and weights.

Thus, a need exists for a folding table having a counterbalance device which does not add to the weight of the members to be lifted and which exerts a constant force during all stages of folding and unfolding.

SUMMARY OF THE INVENTION

In accordance with the present invention, a folding table is provided which is capable of being safely folded and unfolded with a minimum of force required by the operating person. That is accomplished by apparatus which includes one or more constant force gaseous power cylinders positioned within the table so as to provide a maximum mechanical advantage on the table linkages.

The cylinders are constructed so as to produce forces both for assisting in folding the table and for cushioning the table weight during unfolding. The cylinders are completely enclosed, and they require no connections to external sources of working fluid. Further, they contain no mechanical springs.

The cylinders are assembled to the table such that the constant forces produced thereby are directed to urge the table to the folded configuration, that is, to assist the operating person overcome the gravitational force of the table during the folding operation. The cylinders are preferably used in pairs, with one cylinder pair located near each end of the table. One end of each cylinder is anchored to the upstanding table legs which normally support each end of the table and which remain substantially vertical in both the folded and unfolded modes. Thus, the weight of the cylinders is not added to the table members which must be lifted during folding. The other end of each cylinder is attached to a table structural member which pivots with respect to the table end legs. During folding, therefore, some of the force required to lift the table top is supplied by the cylinders, thus reducing the lifting force required of the operator. The table of the present invention is designed such that the attachment points for the cylinders provide a large mechanical advantage to the table linkages, thus further reducing the exertion required by the operating person and also enabling the cylinders to efficiently cushion the unfolding table. The geometric arrangement permits relatively small cylinders to accomplish the required work.

Further in accordance with the present invention, self-contained cylinders with different operating characteristics may be readily combined on a folding table. For example, cylinders having different force capacities may be employed to properly match the required capacity with the table size and weight. For very heavy tables, two or more heavy duty cylinders may be used in conjunction with each folding top section. The combination of a relatively strong and a relatively weak cylinder may be advantageous for some tables. A different number of cylinders may be mounted on each end of the table. The cylinders may be mounted in any orientation, so that the optimum performance characteristics of the cylinders are available for both the folding and unfolding operations.

Other objects and advantages of the invention will become apparent to those skilled in the art from the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
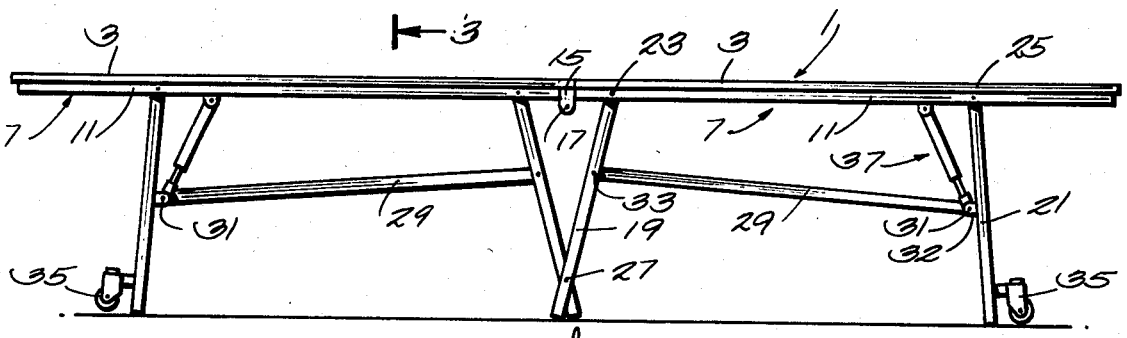
FIG. 1 is a side view of an unfolded typical folding table embodying the present invention.

Referring to FIG. 1, a folding table 1 is illustrated which includes the present invention. The folding table finds particular usefulness in industrial and institutional multi-purpose rooms, but it will be understood that the invention is not limited to indoor use.

The table 1 includes a pair of substantially identical top sections 3 secured in a well known manner to sturdy underframes 7. The top sections 3 may be of any attractive and durable material, such as plastic laminate or wood. The underframes 7 may be of any conventional construction; in the particular construction illustrated, each underframe is fabricated as a pair of steel angles 11 fastened longitudinally along the top sections. Abutting transverse ends of the top sections are hinged together by means of conventional hinges 15 and pins 17. Preferably, the hinges 15 are formed as integral parts of the angles 11.

To support the top sections above the floor, a pair of inner legs 19 and a pair of outer legs 21 are pivotally attached to each underframe 7 by means of pins 23 and 25, respectively. The upper ends of the legs of each pair of legs 19 and 21 are rigidly joined, as by welding, by a horizontal brace. For example, FIG. 3 shows an upper brace 26 extending between and joining the outer legs 21. In addition, the outer legs 21 are joined intermediate their ends by a lower brace 28 welded thereto. The lower ends of the corresponding inner legs are pivotally joined by pins 27, FIGS. 1 and 2. For that purpose, the pairs of inner legs 19 are offset transversely from each other. To coordinate the pivoting of the inner legs 19 and outer legs 21 during the folding and unfolding operations, a stretcher 29 is pivotally joined to the inner and outer legs associated with each top section 3. The pivotal connection to the outer legs is accomplished by means of a pin 31 which extends through aligned aperatures in the stretcher 29 and in a lug 32 welded or otherwise securely mounted to the brace 28. The pivotal connection of the stretcher to the front pair of legs 19 is accomplished by forming the stretcher in a T-shape, with the cross of the tee being hollow and extending between the inner legs 19; a long pin 33 is inserted through aperatures in the legs 19 and through the interior of the stretcher tee.

Figure 2:
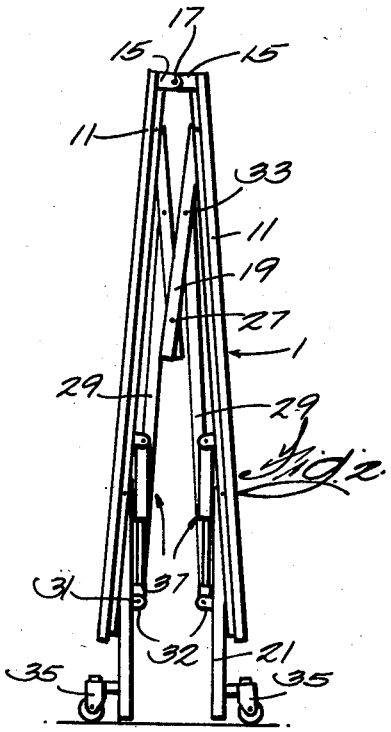
FIG. 2 is a side view of the folding table of FIG. 1 but showing it in the folded mode.
Figure 3:
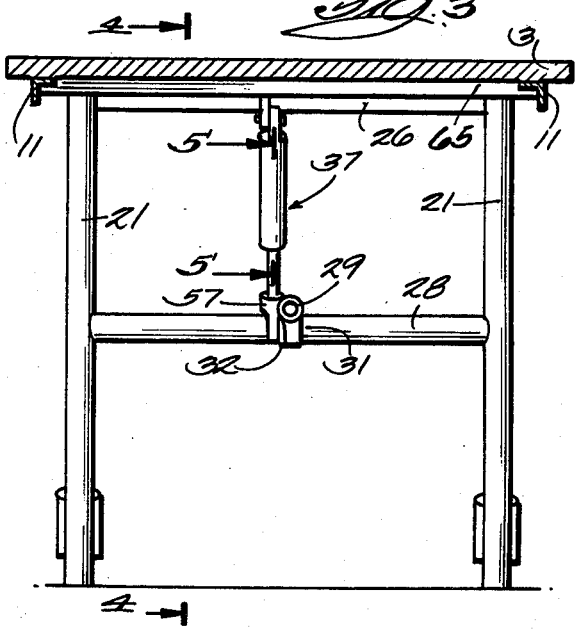
FIG. 3 is a sectional view taken along lines 3—3 of FIG. 1.

FIG. 2 illustrates the table 1 of FIG. 1 in the folded mode. The folded configuration is attained by lifting one or both top sections 3 near the hinges 15. The top sections pivot about pin 17 toward each other, and the legs 19 and 21 and the stretcher 29 pivot with respect to the tops until the fully folded configuration of FIG. 2 is attained.

To permit easy maneuvering of the folded table 1, the lower ends of each pair of outer legs 21 are provided with conventional casters 35. The casters 35 are secured to the legs such that when the table is in the unfolded mode the caster rollers do not contact the floor, FIGS. 1 and 4, as is well known in the art.

Figure 5:
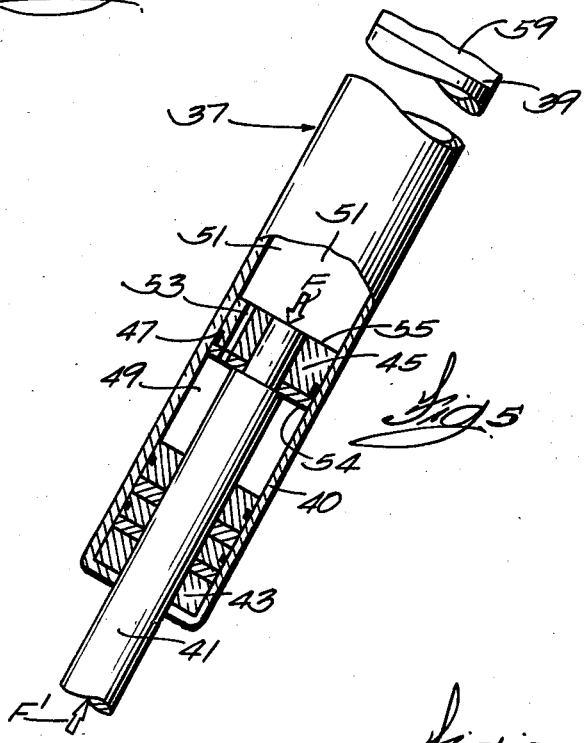
FIG. 5 is a sectional view taken along lines 5—5 of FIG. 3.

The folding table 1 of the present invention includes one or more constant force gaseous power cylinders 37. As best illustrated in FIG. 5, each cylinder 37 comprises a hollow cylindrical casing 40 which is enclosed on one end 39. The end opposite closed end 39 is open to permit a piston rod 41 to reciprocate therethrough. The rod is sealed by resilient annular packing member 43. Connected to the inner end of piston rod 41 is a piston 45. Annular seal 47 is employed to separate the interior of the casing 40 into two chambers 49 and 51. Extending through the piston 45 to provide communication between the chambers 49 and 51 is a relatively small hole 53. The interior of the casing is filled with an inert gas, such as nitrogen, together with a small amount of a suitable lubricant. An acceptable cylinder is a Series 16 cylinder manufactured by Suspa, Inc., of Grand Rapids, Mich. Other cylinders which, under certain circumstances may be acceptable, include those disclosed in U.S. Pat. Nos. 3,963,101 and 4,093,196.

Because of the hole 53 extending through the piston 45, the pressures in chambers 49 and 51 are equal when the piston is at rest. It will be recognized that the area of piston rod end 54 of piston 45 is less than the area of piston face 55. Consequently, the force exerted on face 55 is greater than the force on the end 54, and the piston and rod are constantly urged to the extended position by a net force F. It will be appreciated that the force F is independent of the location of the piston within the casing 40. The speed with which the piston is able to extend is dependent upon the size of the hole 53; gas displaced from chamber 49 to chamber 51 must flow through the hole as the piston and rod extend. Thus, the hole serves as a control for the speed of rod extension.

To retract the piston rod 41 into the casing 40, the net force F on rod end 54 must be overcome. That is accomplished by exerting an external force F′ on the rod greater than force F. The speed with which the rod may be retracted into the casing is dependent on the size of the hole 53 for transferring gas from chamber 51 to chamber 49. Thus, the hole 43 and the gas in chamber 51 act as a cushioning mechanism for large forces F′.

In accordance with the present invention, a cylinder 37 is assembled between the pairs of outer legs 21 and corresponding top sections 3. For that purpose, the outer end of each rod 41 is provided with a clevis 57 having an aperature therein. In the illustrated embodiment, the pin 31 which provides the pivotal connection between brace 28 and stretcher 29 also serves as the pivotal connection between clevis 57 and brace 28, FIGS. 3 and 4. The closed end 39 of the cylinder includes an aperatured flat projection 59. A pin 61 provides a pivotal connection between the projection 59 and a bracket 63 which is mounted to a bar 65 extending between and attached to the angles 11, FIGS. 4 and 5. Thus, as the legs 21 swivel with respect to the frame 7, the cylinder also swivels, and the piston rod reciprocates accordingly within the casing 40.

Figure 4:
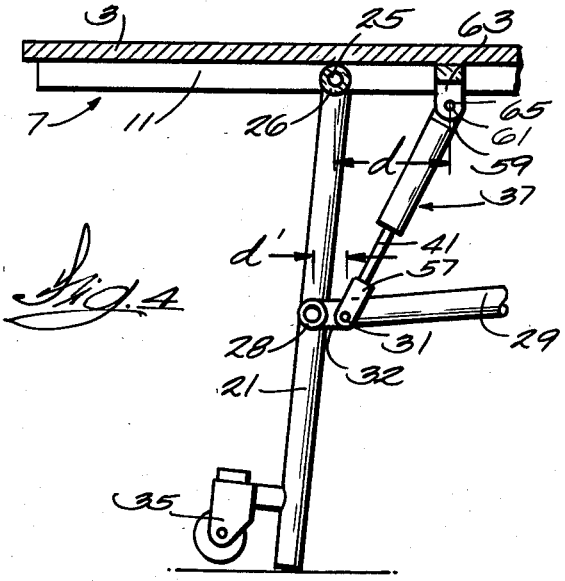
FIG. 4 is a partial sectional view taken along lines 4—4 of FIG. 3.

As described previously, the piston rod 41 is under a constant force F tending to extend it from the casing 40. As best seen in FIG. 4, the piston rod constantly urges the top section 3 to pivot counterclockwise about pin 25. Consequently, the force an operating person must exert on the top sections to fold the table 1 is reduced in proportion to the force F. It will be appreciated that the force capacity of the cylinder 37 and the size of the hole 53 are chosen according to the weight and length of the top sections. Because the cylinder is mounted at one end thereof to the legs 21, the weight of the cylinder is not added to the weight of the table members which must be lifted by the operating person.

To provide the maximum mechanical advantage for the lifting force F of the cylinder, the horizontal distance d between pins 26 and 61 is made as large as practical. The large mechanical advantage provided by distance d also serves to enhance the cushioning effect provided by the cylinder when the top sections 3, whose weight supplies the retracting force F′, are being lowered. To further increase the forces available for lifting and cushioning the table tops during folding and unfolding, respectively, the distance d' between pin 31 and the longitudinal axis of brace 28 is also made as great as practical. As a result, the cylinder 37 is as close to a vertical attitude as practical when the table is unfolded, as shown in FIGS. 1 and 4. It will be understood that, for a constant distance d, increasing distance d' in FIG. 4 so as to permit cylinder 7 to attain a nearly vertical attitude would tend to produce an increased vertical force for lifting and cushioning. However, as is clear from the geometric relationships between the legs 21, lug 32, pin 31, and cylinder 37, increasing distance d' beyond that shown would not permit rod 41 to extend sufficiently from the casing 40 to exert a folding force F throughout the entire folding operation. In addition, the lack of adequate rod extension would reduce or eliminate the cushioning effect of the rod being forced into the casing under the falling weight of the unfolding table. Thus, optimum performance of the folding table of the present invention is obtained with the approximate geometric relationships of the table linkages and cylinders as illustrated.

Figure 6:
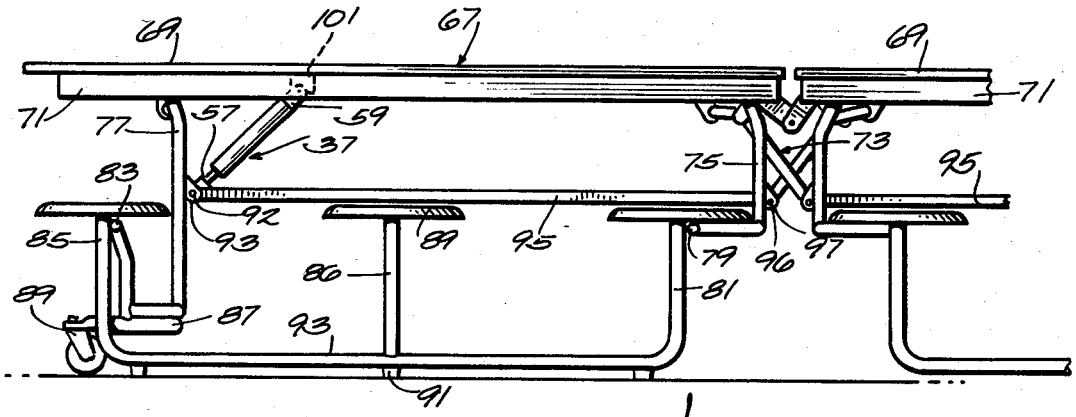
FIG. 6 is a partial side view of a second typical folding table embodying the present invention.
Figure 7:
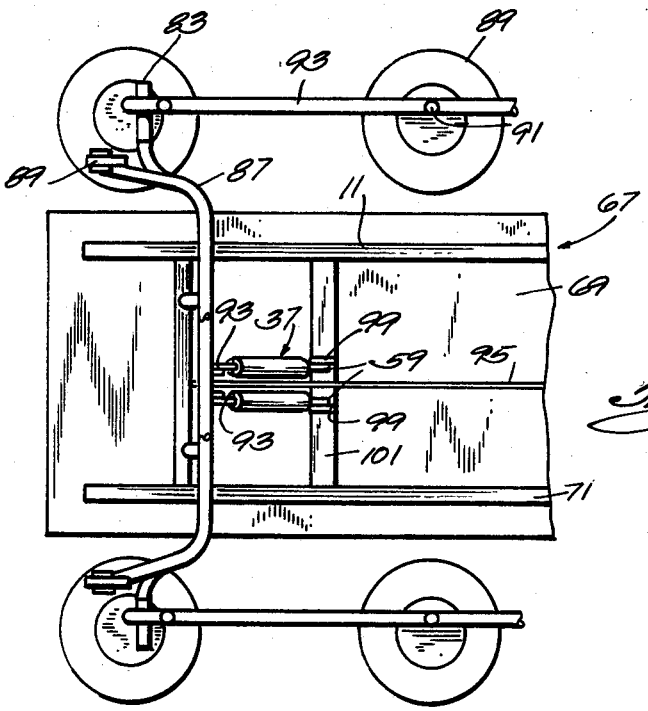
FIG. 7 is a partial bottom view of the table of FIG. 6.

Further in accordance with the present invention, one or more cylinders 37 may be combined on each end of a folding table. Referring to FIGS. 6 and 7, an especially heavy folding table 67 is illustrated which employs four cylinders 37. A detailed construction of the table 67 is described in U.S. Pat. No. 3,715,143. Briefly, the table tops 69 are supported by reinforcing members 71. The table tops are interconnected by a hinge structure 73 rigidly attached to the reinforcing members 71. Each reinforcing member is supported by a pair of inner end frames 75 and outer end frames 77. The lower end of each inner end frame 75 terminates in a swivel end portion 79 adapted to engage a post 81. Outer end frames 77 terminate in a swivel portion 83 adapted to engage a post 85. The posts 81, 85 and 86 support seats 89. The outer end frame is mounted to legs 87 to which are fastened conventional casters 89. The entire folding table 67 is supported on the floor by leveling glides 91 secured to the horizontal section 93. The outer end of each stretcher 95 is pivotally joined by a pin 91 to a lug 93 rigidly joined to a cross brace within outer end frame 77. The inner end of the stretcher 95 is pivotally joined by a pin 96 to a lug 97 rigidly secured to a cross brace which forms a part of the inner end frame 75. The folding table 67, including the seating members 85, 86, 89, 91, and 93, folds from the horizontal unfolded configuration of FIGS. 6 and 7 to an upright folded configuration generally similar to the folded mode of folding table 1 shown in FIG. 2.

To assist the folding operation, a pair of cylinders 37 is employed at each end of the table 67. Clevises 57 are pivotally joined by the pin 92 to the lugs 93. Cylinder flat projections 59 are pivotally connected to brackets 99 which are fastened to a bar 101 extending between and fastened to reinforcing members 71. The heavy construction of the folding table 67 makes it an ideal application for two or more of the constant force cylinders. The forces exerted by the cylinders are always equal regardless of any dimensional variations in the mounting members, such as lugs 93 and brackets 99. In a manner similar to that explained previously, the cylinders are located within the table linkages to provide optimum mechanical advantage for lifting and cushioning.

The performance of the folding tables of the present invention may be further enhanced by selecting cylinders 37 of different capacities to exactly suit the particular table weight and length. It has been found that only two sizes of cylinders, when properly combined in up to two cylinders per table end, adequately handle 14 different models of folding tables.

The versatility of the present invention is further illustrated by the fact that the cylinders 37 may be mounted to the table linkages in the opposite orientation from that shown in FIGS. 1–7. For example, in FIGS. 1–4, the cylinder may be mounted so that clevis 57 is pivotally connected to bracket 63, and projection 59 is pivotally connected to lug 32.

Thus, it is apparent that there has been provided, in accordance with the invention, a folding table with gas cylinders which fully satisfies the objects, aims, and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims. Although in the disclosed constructions at least one cylinder is disclosed at each end of the table, with lightweight tables only one cylinder per table may be necessary.

We claim:

1. In a folding table assembly including first and second longitudinal top sections pivotable between a horizontal unfolded mode and a vertical folded mode; first and second frame means for supporting the respective top sections; hinge means for pivotally connecting the first and second frame means; first and second inner leg means for pivotally supporting the respective frame means near the hinge means; first and second outer leg means for pivotally supporting the respective frame means distal from the hinge means; a first stretcher pivotally attached to the first inner and first outer leg means; and a second stretcher pivotally attached to the second inner and second outer leg means, the first and second stretchers coordinating the pivotal motions of the respective inner and outer leg means with respect to the respective first and second frame means during the folding and unfolding operations, the improvement comprising:

at least one enclosed gaseous constant force power cylinder having a closed end and a rod end, one cylinder end being pivotally connected to a selected outer leg means and the other cylinder end being pivotally connected to the corresponding top section for producing a constant force on the top section tending to pivot the top section to the folded mode, so that the force required to be exerted by an attendant to fold the table is uniformly reduced and the weight of the cylinder is carried by the outer leg means.

2. The improved folding table assembly of claim 1 wherein the cylinder end connected to the table top is connected thereto at a location closer to the respective outer leg means than to the respective inner leg means to thereby increase the vertical component of the cylinder force when the table is in the unfoled mode.

3. The improved folding table assembly of claim 1 wherein the cylinder produces a constant force tending to resist pivoting the top section to the unfolded mode, so that the weight of the unfolding table is uniformly cushioned by the cylinder during the unfolding operation.

4. The improved folding table assembly of claim 3 wherein at least two power cylinders are pivotally connected between each outer leg means and corresponding table top, and wherein the closed and rod ends of the cylinders associated with each table top and outer leg means are connected to the respective outer leg means and table top in opposite orientations to thereby provide different cylinder operating characteristics for aiding in the folding and unfolding operations.

* * * * *